US010662043B2

(12) United States Patent
De Jong

(10) Patent No.: US 10,662,043 B2
(45) Date of Patent: May 26, 2020

(54) LIFTING DEVICE AND SYSTEM WITH INTEGRATED DRIVE UNIT FOR LIFTING A VEHICLE, AND METHOD THERE FOR

(71) Applicant: Stertil B.V., Kootstertille (NL)

(72) Inventor: Jurjen Jan De Jong, Buitenpost (NL)

(73) Assignee: Stertil B.V., Kootstertille (NL)

( * ) Notice: Subject to any disclaimer, the term of this patent is extended or adjusted under 35 U.S.C. 154(b) by 0 days.

(21) Appl. No.: 14/791,644

(22) Filed: Jul. 6, 2015

(65) Prior Publication Data

US 2016/0052757 A1 Feb. 25, 2016

(30) Foreign Application Priority Data

Jul. 4, 2014 (NL) ..... 2013123

(51) Int. Cl.

| | |
|---|---|
| ***B66F 3/24*** | (2006.01) |
| ***B66F 3/30*** | (2006.01) |
| ***B66F 17/00*** | (2006.01) |
| ***B66F 3/46*** | (2006.01) |
| ***B66F 7/06*** | (2006.01) |
| ***B66F 7/20*** | (2006.01) |

(52) U.S. Cl.

CPC ..... *B66F 3/24* (2013.01); *B66F 3/46* (2013.01); *B66F 7/0666* (2013.01); *B66F 7/0691* (2013.01); *B66F 7/20* (2013.01); *B66F 17/00* (2013.01)

(58) Field of Classification Search

None

See application file for complete search history.

(56) References Cited

U.S. PATENT DOCUMENTS

| | | | | |
|---|---|---|---|---|
| 3,783,976 A * | 1/1974 | Kerr | B66F 7/18 187/207 |
| 4,598,797 A | 7/1986 | Schultz | |
| 5,010,710 A * | 4/1991 | Gray | E04H 17/263 173/90 |

(Continued)

FOREIGN PATENT DOCUMENTS

| | | |
|---|---|---|
| AT | 325811 | 1/1975 |
| CA | 2406340 A1 | 12/2003 |

(Continued)

OTHER PUBLICATIONS

Enerpac Hydraulic Submerged Pump found at https://web.archive.org/web/20130403111552/http://pdf.directindustry.com/pdf/enerpac/pe-series-hydraulic-submerged-electric-pumps/14336-255463.html from Apr. 3, 2013.*

(Continued)

*Primary Examiner* — Brian D Keller

(74) *Attorney, Agent, or Firm* — The Webb Law Firm

(57) ABSTRACT

Provided is a lifting device, lifting system and method for lifting a vehicle. The lifting device according to the invention includes a frame with a carrier configured for carrying the vehicle; a drive which acts on the carrier, wherein the drive includes an integrated hydraulic cylinder drive unit configured for raising the carrier with the integrated hydraulic cylinder drive unit including: a housing of a cylinder; a piston rod movable in the housing; a height measuring system configured for measuring the displacement of the piston rod; and an integrated hydraulic fluid tank and motor unit that is configured for driving the piston rod.

17 Claims, 9 Drawing Sheets

(56) References Cited

U.S. PATENT DOCUMENTS

| | | | | |
|---|---|---|---|---|
| 5,341,695 | A | 8/1994 | Avitan | |
| 5,497,083 | A * | 3/1996 | Nakazato | F15B 15/2861 324/207.22 |
| 5,800,114 | A | 9/1998 | Secondi | |
| 6,315,079 | B1 * | 11/2001 | Berends | B66F 3/46 187/203 |
| 6,634,461 | B1 * | 10/2003 | Baker | B66F 3/46 187/210 |
| 6,983,196 | B2 | 1/2006 | Green et al. | |
| 7,014,012 | B2 | 3/2006 | Baker | |
| 7,025,178 | B2 | 4/2006 | Wengelski et al. | |
| 7,219,770 | B2 | 5/2007 | Baker | |
| 7,712,583 | B2 | 5/2010 | Matsumoto | |
| 7,740,109 | B2 | 6/2010 | Moller et al. | |
| RE41,554 | E | 8/2010 | Baker | |
| 7,784,587 | B2 | 8/2010 | Zablocky | |
| 8,083,034 | B2 | 12/2011 | Bordwell et al. | |
| 8,251,184 | B2 | 8/2012 | De Jong | |
| 8,567,761 | B2 | 10/2013 | De Jong et al. | |
| 8,708,107 | B2 | 4/2014 | Finkbeiner | |
| 8,944,217 | B2 | 2/2015 | Anasis et al. | |
| 9,352,944 | B2 | 5/2016 | Fagan et al. | |
| 2004/0262085 | A1 | 12/2004 | Mueller | |
| 2005/0182522 | A1 | 8/2005 | Chase | |
| 2006/0182563 | A1 | 8/2006 | De Jong et al. | |
| 2008/0154691 | A1 | 6/2008 | Wellman et al. | |
| 2008/0277204 | A1 | 11/2008 | Moller et al. | |
| 2009/0038393 | A1 | 2/2009 | Chaung et al. | |
| 2009/0205907 | A1 | 8/2009 | Berends | |
| 2009/0236183 | A1 | 9/2009 | Bordwell et al. | |
| 2009/0263225 | A1 * | 10/2009 | Faccio | B66C 23/305 414/718 |
| 2009/0265059 | A1 | 10/2009 | Medwin et al. | |
| 2010/0063637 | A1 * | 3/2010 | Crowell | B66F 7/16 700/279 |
| 2010/0066278 | A1 | 3/2010 | De Jong | |
| 2010/0066287 | A1 | 3/2010 | Street | |
| 2011/0037041 | A1 | 2/2011 | De Jong et al. | |
| 2011/0083504 | A1 | 4/2011 | Unger | |
| 2013/0213744 | A1 | 8/2013 | Foley | |
| 2013/0240300 | A1 | 9/2013 | Fagan et al. | |
| 2013/0249812 | A1 | 9/2013 | Helmich | |
| 2013/0270040 | A1 | 10/2013 | Berends | |
| 2014/0234122 | A1 * | 8/2014 | Donohoe | F04B 23/04 417/53 |
| 2015/0136491 | A1 * | 5/2015 | White | E21B 43/126 175/57 |
| 2015/0232309 | A1 | 8/2015 | Jaipaul et al. | |
| 2015/0246797 | A1 | 9/2015 | Jaipaul et al. | |
| 2016/0052757 | A1 | 2/2016 | De Jong | |
| 2016/0101877 | A1 | 4/2016 | Shepherd et al. | |

FOREIGN PATENT DOCUMENTS

| | | | |
|---|---|---|---|
| DE | 3618072 | A1 | 12/1987 |
| DE | 4306680 | A1 | 9/1994 |
| DE | 19508346 | C1 | 6/1996 |
| DE | 102005035391 | A1 | 2/2007 |
| EP | 0158456 | A2 | 10/1985 |
| EP | 0747535 | A1 | 12/1996 |
| EP | 2163506 | A1 | 3/2010 |
| FR | 1373217 | A | 9/1964 |
| FR | 2631017 | A1 | 11/1989 |
| JP | 10265186 | A | 10/1998 |
| WO | 03037777 | A1 | 5/2003 |
| WO | 2008074008 | A2 | 6/2008 |
| WO | 200909129295 | A2 | 10/2009 |
| WO | 2012051696 | A1 | 4/2012 |
| WO | WO 2012/088019 | * | 6/2012 |

OTHER PUBLICATIONS

Stertil-Koni; ST 1075 Mobile Column One Post Lifts; http://www.stertil-koni.com/en/products/mobile-column-lifts/mobile-lifts/st1075; reproduced from internet on Aug. 17, 2015.

Stertil-Koni; ST 2070 Two Post Lifts; http://koni.stertil.co.uk/en/products/two_post_vehicle_lifts/sk2070; reproduced from internet on Aug. 17, 2015.

Stertil-Koni; ST 4120 Four Post Lifts; http://www.stertil-koni.com/en/products/platform-lifts/4postlifts/four_post_lift_ST4120; reproduced from internet on Aug. 17, 2015.

International Search Report PCT/NL2016/050481 dated Nov. 4, 2016.

* cited by examiner

LIFTING DEVICE AND SYSTEM WITH INTEGRATED DRIVE UNIT FOR LIFTING A VEHICLE, AND METHOD THERE FOR

This application claims priority to Netherlands Patent Application No. 2013123 filed Jul. 4, 2014, the disclosure of which is incorporated herein by reference in its entirety.

BACKGROUND OF THE INVENTION

1. Field of the Invention

The invention relates to a vehicle lifting device that is used for lifting trucks and busses, or other vehicles and may involve lifting columns of the two-post lift type with pivoting support arms, the four-post lift type with runways, the mobile type, in-ground lifts, etc.

2. Description of the Related Art

Lifting devices embodied as a lifting column are known from practice and comprise a frame with a carrier that is connected to a drive for moving the carrier upwards and downwards. In the ascent mode, hydraulic oil is pumped to a cylinder for lifting the carrier and, therefore, the vehicle. In the descent mode, the carrier with the vehicle is lowered and hydraulic oil returns to the reservoir. Such prior art lifting system is disclosed in U.S. Patent Application Publication No. 2006/0182563, which is incorporated herein by reference.

Known lifting devices utilize hydraulic lifting circuits that are rather complex and utilize a combination of check valves and pressure compensation flow control (PCFC) valves or proportional valves. Also, these hydraulic lifting circuits require the use of a number or hoses and connections. This involves a high risk of failure leading to high maintenance costs and downtime.

SUMMARY OF THE INVENTION

An object of the invention is to obviate or at least reduce the above problems.

This object is achieved with a lifting device for lifting a vehicle according to the invention, the vehicle lifting device comprising:

- a frame with a carrier configured for carrying the vehicle;
- a drive which acts on the carrier,
- wherein the drive comprises an integrated hydraulic cylinder drive unit configured for raising the carrier, the integrated hydraulic cylinder drive unit comprising:
- a housing of a cylinder;
- a piston rod movable in the housing;
- a height measuring system configured for measuring the displacement of the piston rod; and
- an integrated hydraulic fluid tank and motor unit that is configured for driving the piston rod.

The carrier of the lifting device is capable of carrying the vehicle that needs to be lifted. The carrier is moved upward and/or downward with a drive. According to the invention, the drive comprises an integrated hydraulic cylinder drive unit that is configured for raising the carrier. This unit comprises, in an integrated manner, a housing, a piston rod that is movable in the housing of the cylinder, and a height measuring system that is configured for measuring the displacement of the piston rod. The use of this height measuring system enables the direct measurement of the piston rod that is directly related to the height of the carrier.

This provides a direct measurement enabling a direct feedback on the actual displacement of the carrier that in a presently preferred embodiment is performed contactless, i.e. without physical contact between the height measurement system and piston rod. This obviates the need for separate sensor systems, thereby reducing the complexity of the lifting device, and reducing the risk of additional noise or disturbances on measurement signals and/or communication between the different components of the lifting device. Furthermore, as the height measurement can be performed directly on the displacement of the piston rod the feedback of the displacement is directly available such that there is no time delay and, if necessary, appropriate control actions can be taken directly. This improves the safety of the lifting device according to the present invention.

Furthermore, the lifting device according to the present invention comprises an integrated hydraulic fluid tank and motor unit, as part of the integrated cylinder drive unit, that is configured for driving the piston rod. Integrating the hydraulic fluid tank and motor in one unit reduces the need for space required for these components in the lifting device and enables a relatively compact construction. Such compact construction significantly reduces the number and/or length of hoses and other connections between the individual units or components of the lifting device according to the present invention. This renders the lifting device according to the invention more cost effective and, in addition, reduces the risk of failure of components and/or connections. In particular, the risk of hydraulic fluid leaking from a connection is reduced significantly.

Lifting devices according to the invention include lifting columns of the two-post lift type with pivoting support arms, the four-post lift type with runways, the mobile type lifting columns, in-ground lifts etc. As an example, a number of lifting devices can be grouped together as a lifting system. In an embodiment of such a lifting system according to the invention, when lifting a vehicle at least two lifting columns are being used. In fact, often four lifting columns are being used. During such lifting operation, the timing of these separate lifting columns including the moving speed of the carrier that carries (part of) the vehicle when lifting a vehicle, requires synchronization. The control of the lifting system preferably comprises a system controller that synchronizes the height of the separate carriers in the ascent mode using, for example, a measurement signal generated by a height sensor, for example a potentiometer and/or more preferably the height measurement system according to a presently preferred embodiment of the present invention. Of course, other sensors can also be used. In case one of the carriers has moved too fast in the ascent mode and is too high as compared to the other carriers of the other lifting columns, for example the power supply to this carrier is either directly or indirectly lowered so that the other carriers can catch up or, alternatively, the power supply to the other carriers is either directly or indirectly increased so that the other carriers can catch up. In the descent mode, it is also important that the height of the carriers between the several lifting columns is synchronized. Therefore, in case one of these carriers has moved too slowly, for example its power supply is increased in order for this carrier to catch up with the other carriers or, alternatively, the power supply to the other carriers is either directly or indirectly lowered so that the other carriers can catch up.

In a presently preferred embodiment according to the present invention, the height measuring system comprises a sensor code that is provided on the piston rod, and a sensing element configured for reading the sensor code to determine the extension of the displacement of the piston rod.

Providing a sensor code directly on the piston rod enables a direct measurement of the displacement of this piston rod by providing a sensing element. This sensing element is configured for reading the sensor code to determine the displacement. This enables a direct measurement of the displacement of the piston rod and, therefore, the location of the carrier of the lifting device.

In a presently preferred embodiment the sensor code is a magnetic code. The piston rod acts as host for the sensor code and is preferably of a steel material. The sensing element is preferably a row of magnetic field sensors which are located in the proximity of the sensor code. The use of such configuration enables measuring changes in the magnetic field(s) caused by displacement of the piston rod such that the sensing element, for example embodied as coils, respond to the magnetic field changes. This provides a measurement of the actual displacement of the piston rod and therefore of the height of the carrier of the lifting device. The measurement signal can be supplied to a lifting device controller that monitors and controls the height of the carrier. If required, the lifting device controller may compare the height of an individual carrier with heights of other carriers and determine corrective action, if necessary. Such corrective action may involve raising or lowering individual carriers in addition to the original steering command.

In a further preferred embodiment according to the present invention the height measuring system of the lifting device comprises a locking system that is configured for locking the piston rod in response to an indication, such as a signal, of the height measuring system that the piston rod has reached a desired position.

By providing a locking system in cooperation with the height measuring system of the lifting device according to the present invention a direct command for locking and/or unlocking the piston rod can be achieved. This lock/unlock signal can be supplied by the measuring system directly, or alternatively by a lifting device controller, to the locking system. Having the locking system acting directly on the piston rod, provides a direct locking means that provides a (direct) possibility to maintain the piston rod, and the carrier, at the desired height with improved accuracy.

Preferably, the locking system comprises a number of rod clamps. This number of rod clamps can be one, two, four or any other number of clamps. In a presently preferred embodiment the locking system comprises two rod clamps that directly engage the piston rod. More preferably, the rod clamps are hydraulically de-activated such that locking system is capable of holding the piston rod at the desired height. This provides a locking system that is both robust, stable and can be operated with high accuracy. In addition, by the preferred combination of height measuring system and locking system, the actual locking position can be determined efficiently and with high accuracy thereby contributing to the overall safety of the lifting device according to the present invention.

In a presently preferred embodiment according to the invention the locking system is configured to provide a continuously adjustable locking of the piston rod. This enables locking at any desired position of the piston rod, and therefore at any desired height of the carrier. Conventional lifting devices have a pitch between locking positions due to the functioning of the pawl or latch in the locking system provided on the mast of the lifting column. In case in one of such conventional lifting columns the locking does not function properly this introduces height differences equal to the pitch, for example in the range of 35-100 mm. It will be understood that this introduces a safety risk. In addition, in such case remaining conventional columns are confronted with additional loads that may add to the safety risk. This problem is solved with the continuously adjustable locking system according to the invention, wherein preferably rod clamps directly act on the piston rod. This provides a direct and continuously adjustable locking without requiring a pitch.

In a further preferred embodiment according to the present invention the integrated fluid hydraulic tank and motor unit comprises a hydraulic fluid reservoir with a submerged pump.

By providing the hydraulic fluid tank and motor unit with a hydraulic fluid reservoir and a submerged pump therein, a compact and effective hydraulic fluid circuit is achieved with a significant reduction of the number of hoses and connections. This reduces the risk of hydraulic fluid, such as hydraulic oil, leaking from the lifting device. In addition, the amount of hydraulic fluid that is required in a lifting device is further reduced.

Preferably the reservoir comprises a direct valve connection between the reservoir and the housing of the cylinder. This enables a direct interaction between a chamber of the hydraulic cylinder and the reservoir thereby further reducing the need for additional hoses and connections. This further reduces the number of components in the lifting device according to the present invention and even further reduces the risk of hydraulic fluid leaking from the lifting device.

The present invention also relates to a lifting system comprising one or more of the aforementioned lifting devices.

The lifting system provides the same effects and advantages as those stated for the lifting device. For example, the lifting system may comprise a number of lifting columns acting as lifting device. The individual lifting devices/columns can be controlled by a central controller of the lifting system, for example. This enables an effective and efficient comparison of the actual height of the individual carriers of the lifting devices. Performing the direct measurement and the preferred direct locking/unlocking of the piston rod at a desired position provides additional accuracy and safety to the lifting system.

The present invention further also relates to a method for lifting a vehicle, the method comprising the step of providing an aforementioned lifting device and/or lifting system.

The method provides the same advantages and effects as those stated with reference to the lifting device and lifting system. In particular, the use of the lifting device(s) according to the present invention increases the overall safety and robustness of the lifting operation, and in addition, reduces the risk of failure including hydraulic fluid leaking from a lifting device.

BRIEF DESCRIPTION OF THE DRAWINGS

An exemplary embodiment of a lifting device and lifting system according to the present invention is described herein below on the basis of a non-limitative exemplary embodiment thereof shown in the accompanying drawings, wherein.

DESCRIPTION OF THE INVENTION

Figure 1:
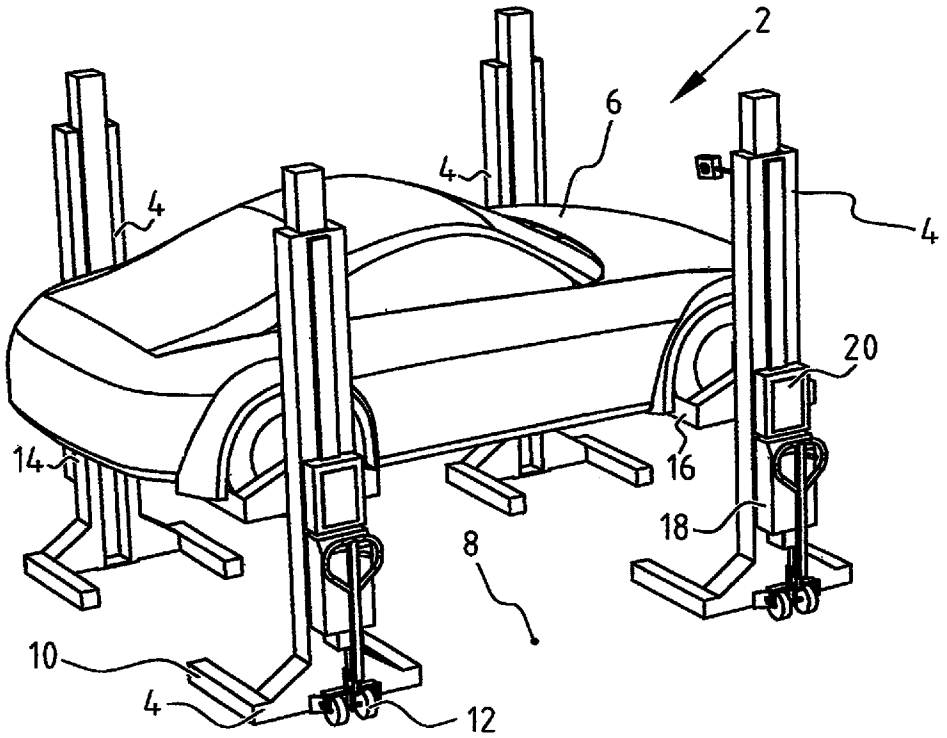
FIG. 1 shows a schematic overview of a vehicle lifted by lifting columns of a lifting system according to the invention.

A system 2 for efficient lifting and lowering a load (FIG. 1) comprises four mobile lifting columns 4 in the illustrated embodiment. Lifting columns 4 lift a passenger car 6 from the ground 8. Lifting columns 4 are connected to each other and/or a control system by wireless communication means or alternatively by cables. Lifting columns 4 comprise a foot 10 which can travel on running wheels 12 over ground surface 8 of for instance a floor of a garage or workshop. In the forks of foot 10 is provided an additional running wheel (not shown). Lifting column 4 furthermore comprises a mast 14. A carrier 16 is moveable upward and downward along mast 14. Carrier 16 is driven by a motor 18 of the drive of the lifting column that is provided in a housing of lifting column 4. Motor 18 is supplied with power from the electrical grid or by a battery that is provided on lifting column 4 in the same housing as motor 18, or alternatively on foot 10 (not shown). Control with control panel 20 is provided to allow the user of system 2 to control the system, for example by setting the speed for the carrier 16. In one embodiment, motor 18 is a 3-phase low voltage motor controlled by a separate controller. In another embodiment, motor 18 is a 3-phase low voltage motor with integrated controller. Such motor with integrated controller can also be used in combination with conventional lifting devices with conventional height measurement systems.

Lifting system 2 includes at least two lifting columns 4. Each of the lifting columns has at least one ascent mode and one descent mode, and is under the influence of a control 20. Control 20 can be designed for each lifting column 4 individually, or for the lifting columns 4 together. A pressure or load sensor may be used for monitoring, control and indication of the load that is lifted with lifting system 2.

Integrated hydraulic cylinder drive unit 22 (FIG. 2A) comprises a cylinder housing 24 wherein piston rod 26 can be displaced. Height measuring system 28 measures sensor code 30 that is provided on piston rod 26 using sensor system 32 comprising a number of sensor coils 34. In the illustrated embodiment sensor code 30 is a magnetic code. Displacement of piston rod 26 changes the magnetic field that is measured with sensor coils 34.

Figure 2A:
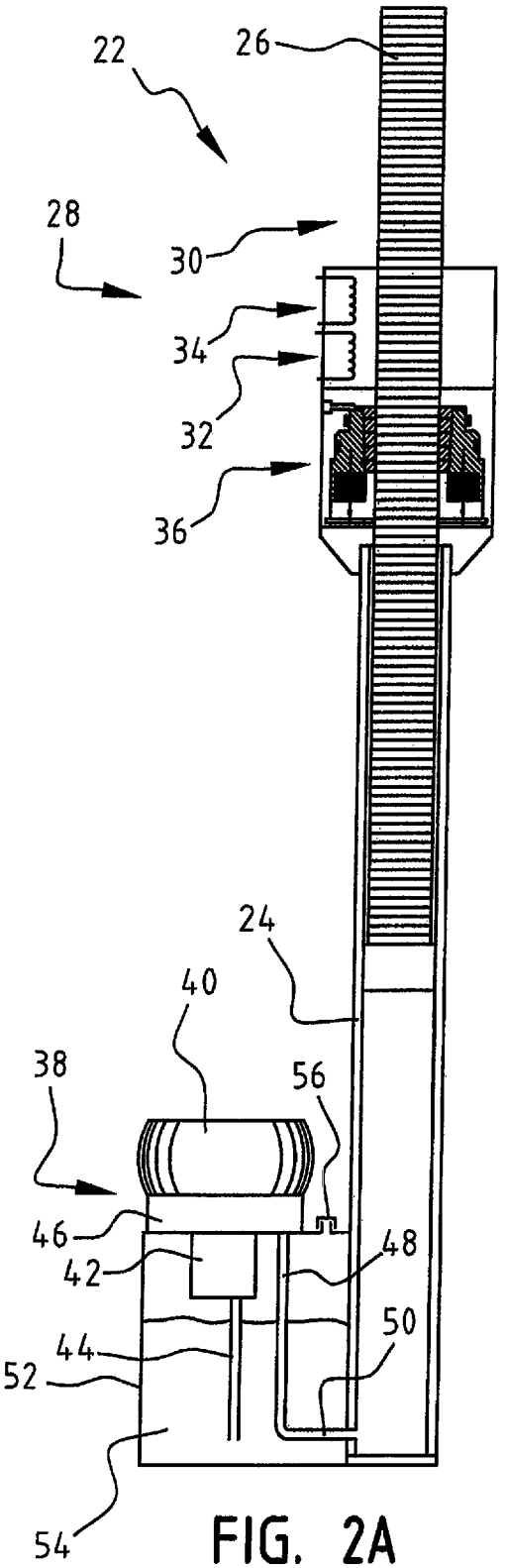
FIG. 2A-B shows a drive for the hydraulic cylinder of the system of FIG. 1.

In the illustrated embodiment locking system 36 is integrated in height measuring system 28 (FIG. 2A). Locking system 36 (FIG. 2B) comprises a spring element 36*a*, clamp block 36*b*, hydraulic fluid supply 36*c* and rod clamp 36*d*.

Without oil or hydraulic fluid pressure spring element 36*a* forces clamp block 36*b* upwards thereby forcing rod clamps 36*d* inward into direct contact with piston rod 26. This locks piston rod 26 and prevents displacement thereof (FIG. 2A).

Figure 2B:
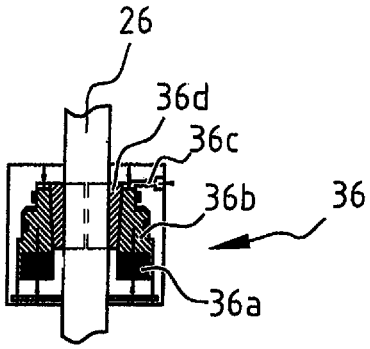

When supplying fluid pressure through supply 36*c* clamp, block 36*b* is forced downward against the spring force of spring element 36*a*. This enables rod clamp 36*d* to move outward away from piston rod 26 thereby unlocking piston rod 26 and enabling displacement thereof (FIG. 2B). As a result, the height measuring system 28 activates the at least one rod clamp 36*d* of the locking system 36 for positive engagement of the at least one rod clamp 36*d* against the piston rod 26 and wherein the locking system rod clamp 36*d* is positively engaged without being pressurized by the oil or hydraulic fluid. Furthermore, the locking system 36 includes a hydraulic fluid supply which, when activated, acts directly against and forces the clamp block 36*b*, which is securing the rod clamp 36*d*, to release the rod clamp 36*d* from the piston rod 26 enabling displacement of the piston rod 26 relative to the rod clamp 36*d*.

The advantage of the illustrated embodiment is that when hydraulic fluid pressure is accidentally removed from the system, piston rod 26 is locked and maintained in a safe position. This provides additional safety to the lifting device 2 according to the present invention. It will be understood that alternative configurations of lock system 36 would also be possible in accordance with the present invention. In the illustrated embodiment the two rod clamps 36*b* are embodied as semi-circular bodies to increase the contact area between rod clamp 36*d* and piston rod 26. It will be understood that another number of rod clamps 36*d* can also be applied in accordance with the invention. As a result, the locking system 36 is utilized to both lock the piston rod 26 at any position along the length of the piston rod 26 with the height measuring system 28 and also to lock and maintain in a safe position the piston rod 26 when hydraulic fluid is accidently removed from the system.

Integrated hydraulic fluid tank and motor unit 38 (FIG. 2A) comprises motor 40, pump 42 with suction pipe 44 (FIG. 2A). Valve block 46 directs hydraulic fluid 54 from reservoir 52 towards supply pipe 48 towards connection 50 between reservoir 52 and cylinder housing 24 and vice versa depending on the direction of displacement of piston rod 26. An inlet/outlet opening 56 is provided to reservoir 52.

In the illustrated embodiment, when carrier 16 needs to be raised, piston rod 26 will displace. In the illustrated embodiment piston rod 26 will move in an upward direction by providing hydraulic fluid 54 to cylinder housing 24 with pump 42 that is driven by motor 40. After sensing with height measurement system 28 that piston rod 26 has reached the desired height or the desired position, and therefore carrier 16 has reached its desired height, locking system 36 locks piston rod 26. In case carrier 16 needs to be lowered, locking system 36 unlocks piston rod 26 and piston rod 26 will displace in a downward direction thereby forcing hydraulic fluid 54 back into reservoir 52.

Figure 3:
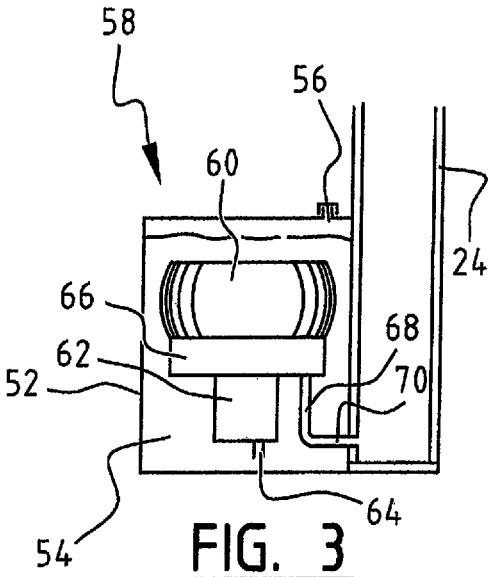
FIG. 3 shows an alternative embodiment for the drive according to the invention.

In an alternative embodiment of an integrated hydraulic fluid tank and motor unit 58 (FIG. 3), pump 60 is submerged in hydraulic fluid 54 in reservoir 52 together with valve block 66, pump 62, suction pipe 64, supply pipe 68 and connection 70. It will be understood that this results in an increased compactness of the integrated hydraulic fluid tank and motor unit.

Figure 4:
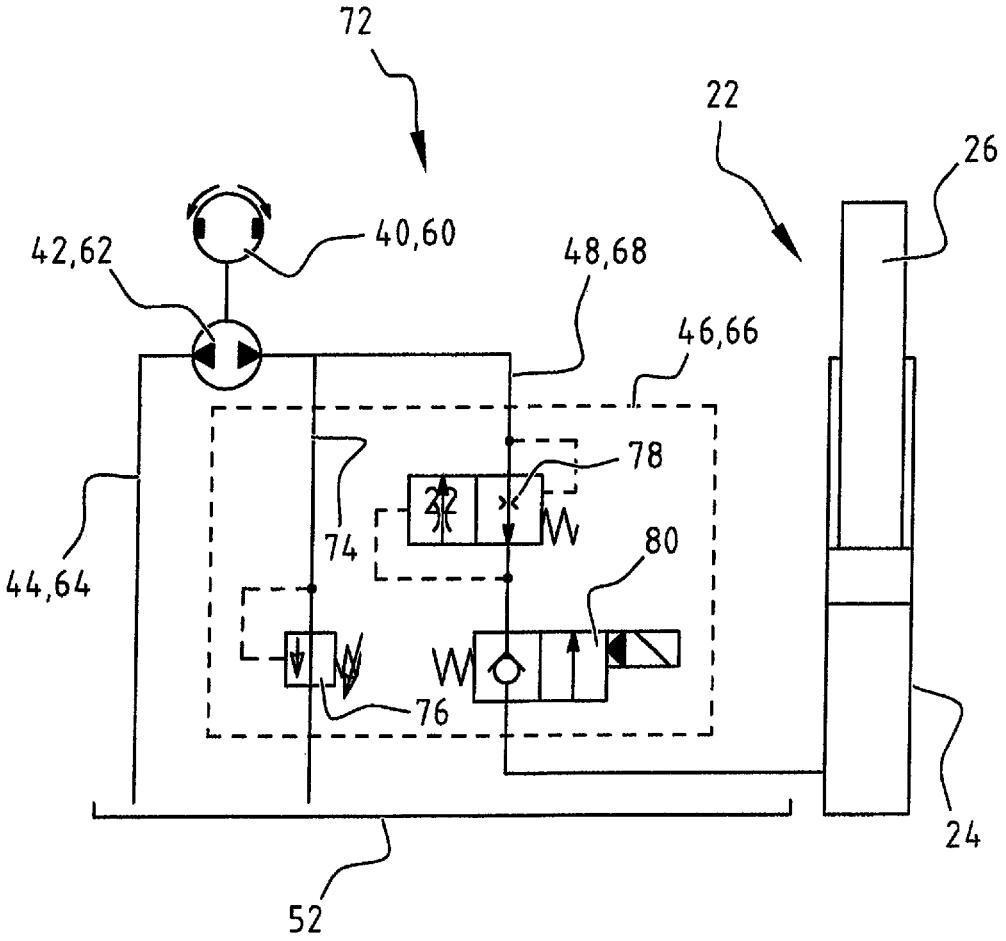
FIG. 4 shows a schematic overview of the hydraulic scheme of the drive of FIG. 2.

Hydraulic scheme 72 (FIG. 4) illustrates the hydraulic connection between individual components of lifting device 2. Hydraulic scheme 72 illustrates the reduction of components, hoses and connections in lifting device 2 in comparison with conventional lifting devices. In the illustrated embodiment valve block 46, 66 comprises a safety/recirculation pipe 74 with valve 76 enabling recirculation of hydraulic fluid in reservoir 52. Supply pipe 48, 68 is provided with valve 78 and valve 80. It will be understood that alternative embodiments of hydraulic scheme 72 can be envisaged in accordance with the present invention.

An alternative height measurement that can be used in addition, or as an alternative, to other height measurements, is measurement of the level of hydraulic fluid in reservoir 52, for example with a level sensor using ultrasound or induction. This measurement is also capable of detecting leakage of hydraulic fluid.

The present invention can be applied to the (wireless) lifting columns illustrated in FIG. 1. Alternatively the invention can also be applied to other types of lifting columns and lifting systems that will be described next.

Figure 5:
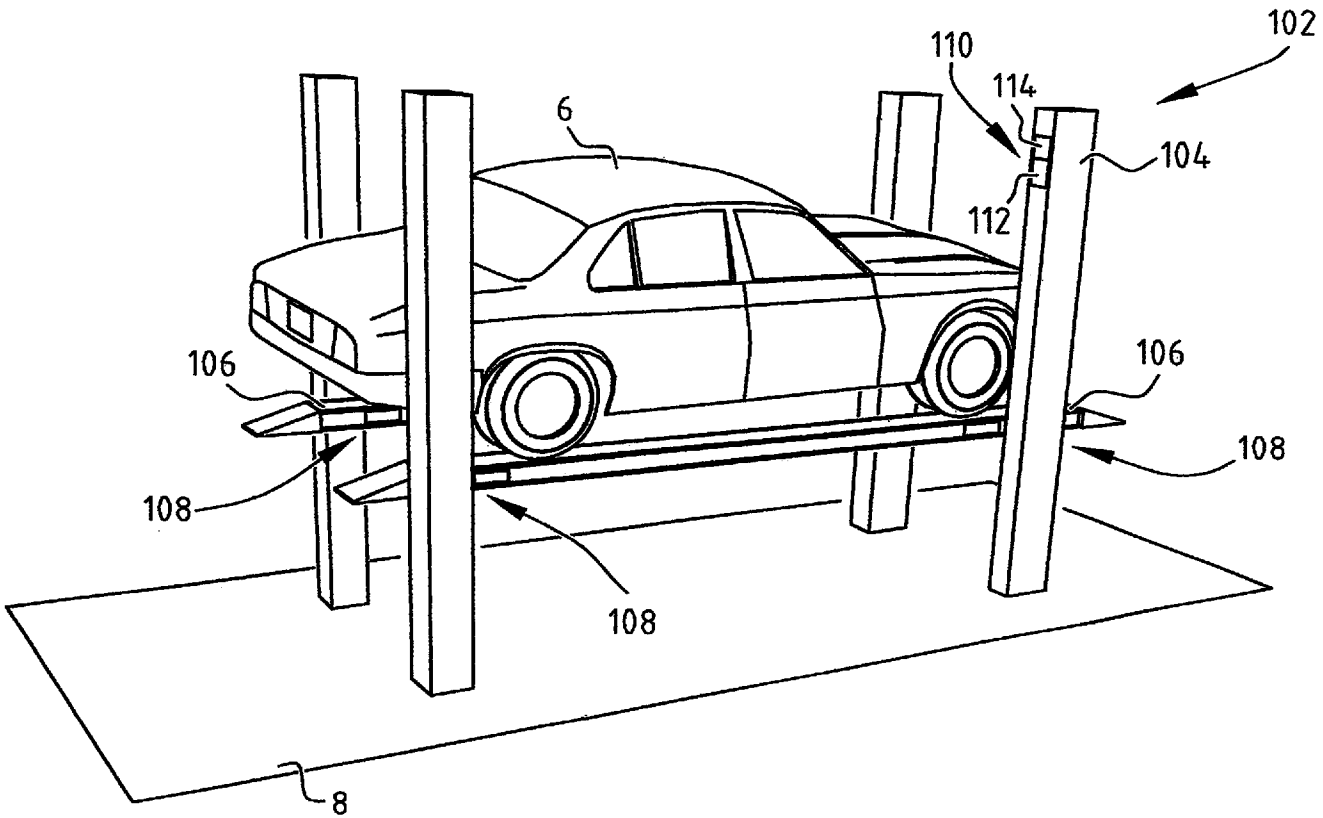
FIGS. 5-7 show alternative embodiments of lifting columns of lifting systems according to the invention.

For example, a four-post lifting system 102 (FIG. 5) comprises four columns 106 carrying runways 106. Optionally, columns 104 comprise sensor 108. In the illustrated embodiment an indicator 110 with a green light 112 and a red light 114 is provided. Indicator 110 can be used for load sensing. Light 110 signals to the driver when vehicle 6 is positioned correctly relative to columns 104 and the vehicle 6 can be lifted. In case each column 104 is provided with sensor 108 the position of the carrier 106 can be double checked in relation to height measurement system 28. This contributes to the overall safety of the lifting operation. In addition thereto, or as an alternative therefor, indicator 110 can be used for position or speed control to indicate to a user that the system is operating correctly with carriers/runways 106 being at the same height, or indicate that there is some safety concern, for example.

Figure 6:
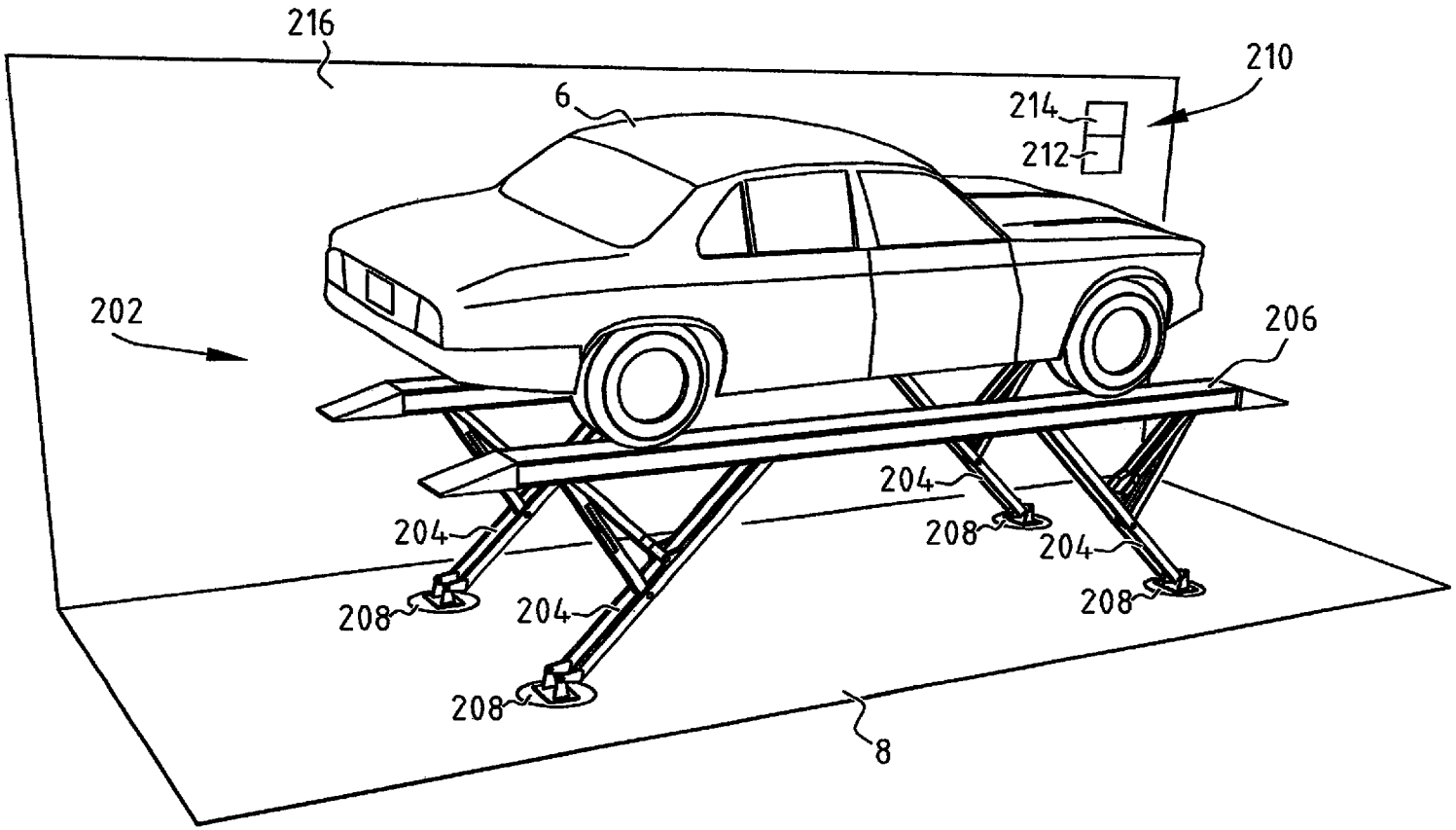

As a further example, lifting system 202 (FIG. 6) comprises a so-called sky-lift configuration with four posts 204 carrying runways 206. In the illustrated embodiment, optionally, additional sensor 208 is provided for every post 204. This enables an additional safety check in addition to that of height measuring system 28 on positioning 206 of the carrier as described earlier. A light 210 with green 212 and red 214 lights can be provided on wall 216 to indicate to the driver of vehicle 6 that the vehicle is positioned correctly or needs to be repositioned and/or to indicate the controller status and/or indicate correct positions of carriers 206.

Figure 7:
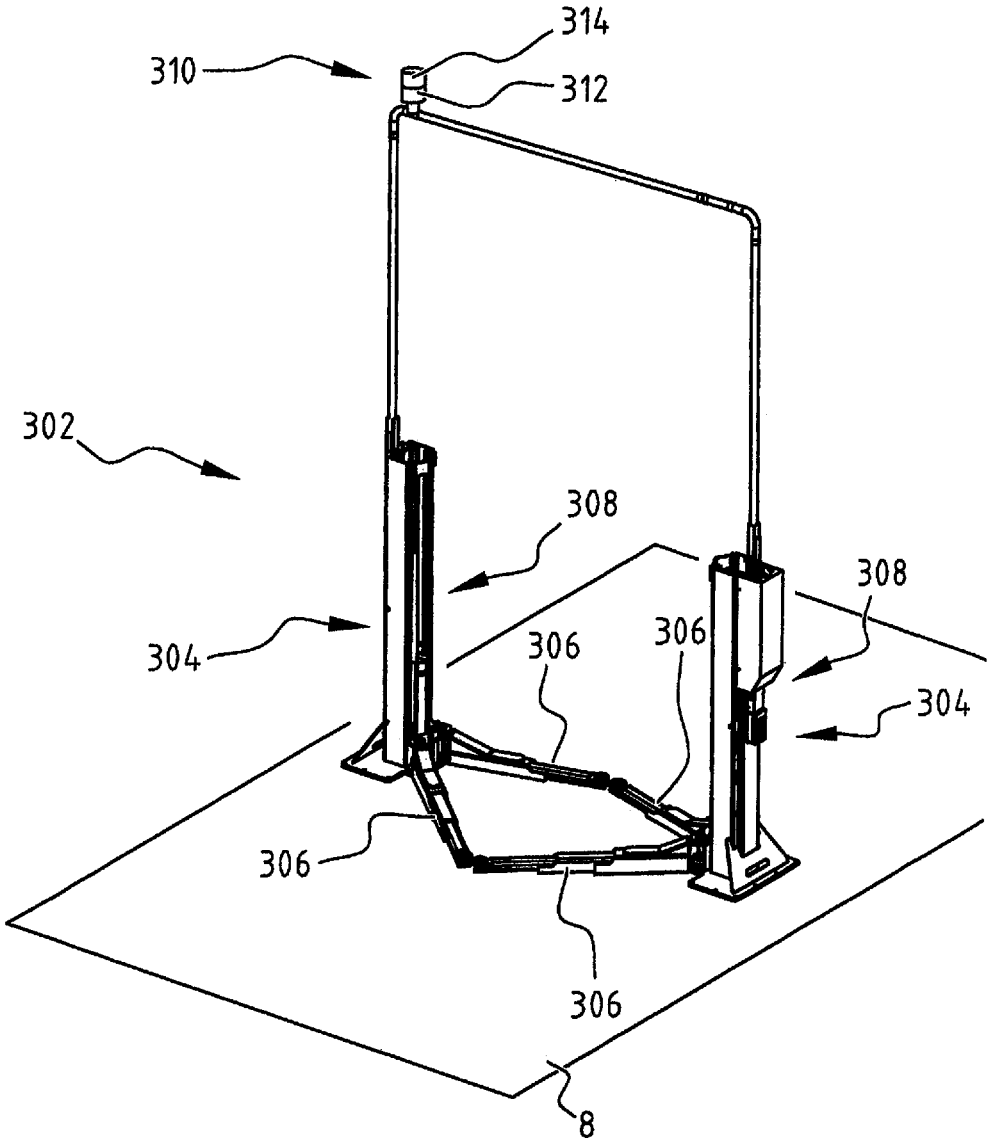

As an even further example, lifting system 302 (FIG. 7) comprises a so-called two-post configuration with two posts 304 that are provided with carrier arms 306. In the illustrated embodiment to measure position and speed of carrier arms 306, optionally, additional sensor 308 is provided. This enables an additional check on positioning of carriers/arms 306 as described earlier. A light 310 with green 312 and red 314 lights can be provided to indicate to the driver of vehicle 6 that the vehicle is positioned correctly or needs to be repositioned and/or to indicate the controller status.

Figure 8A:
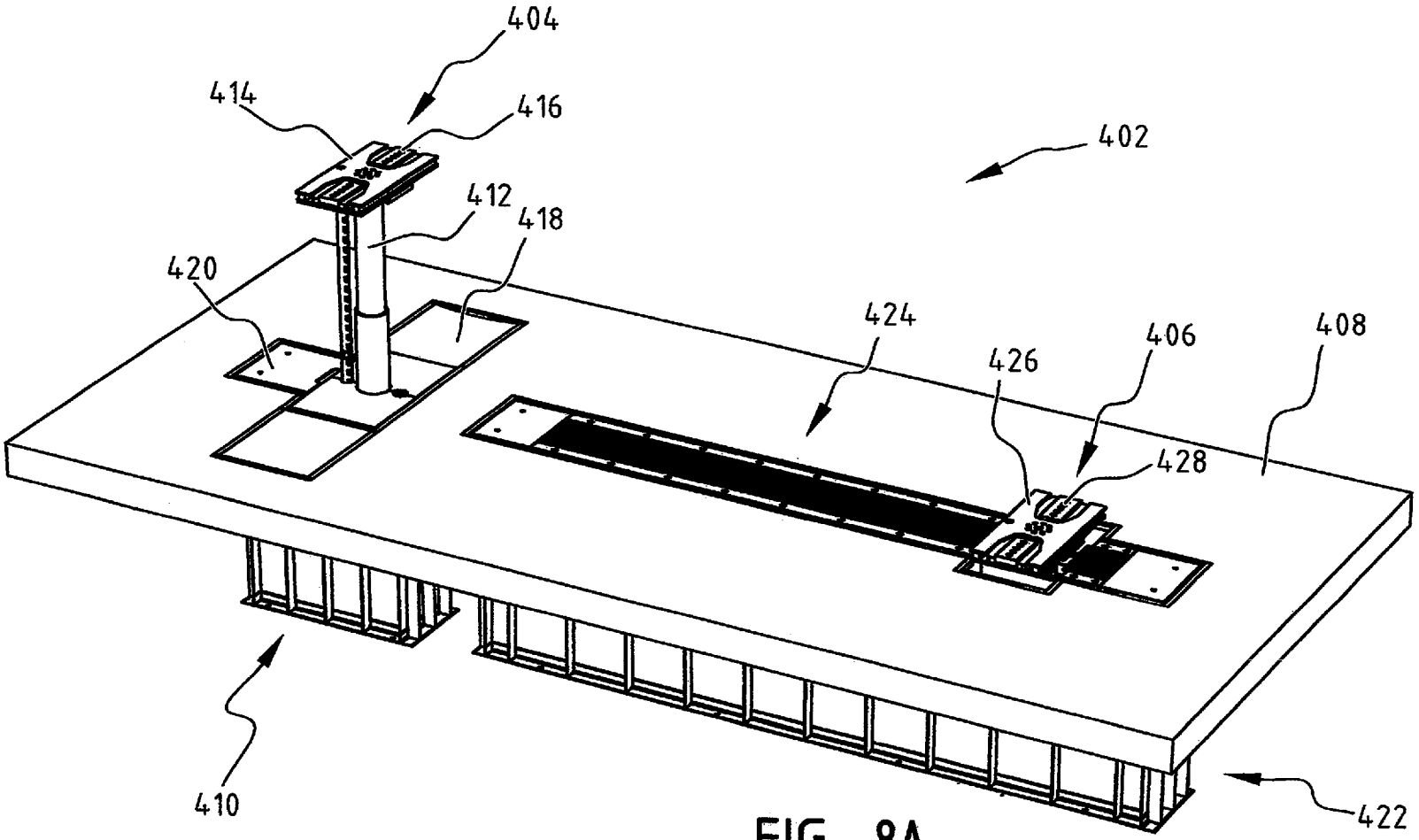
FIGS. 8A-B and 9 show further alternative in-ground embodiments of lifting devices of a lifting system according to the invention.
Figure 8B:
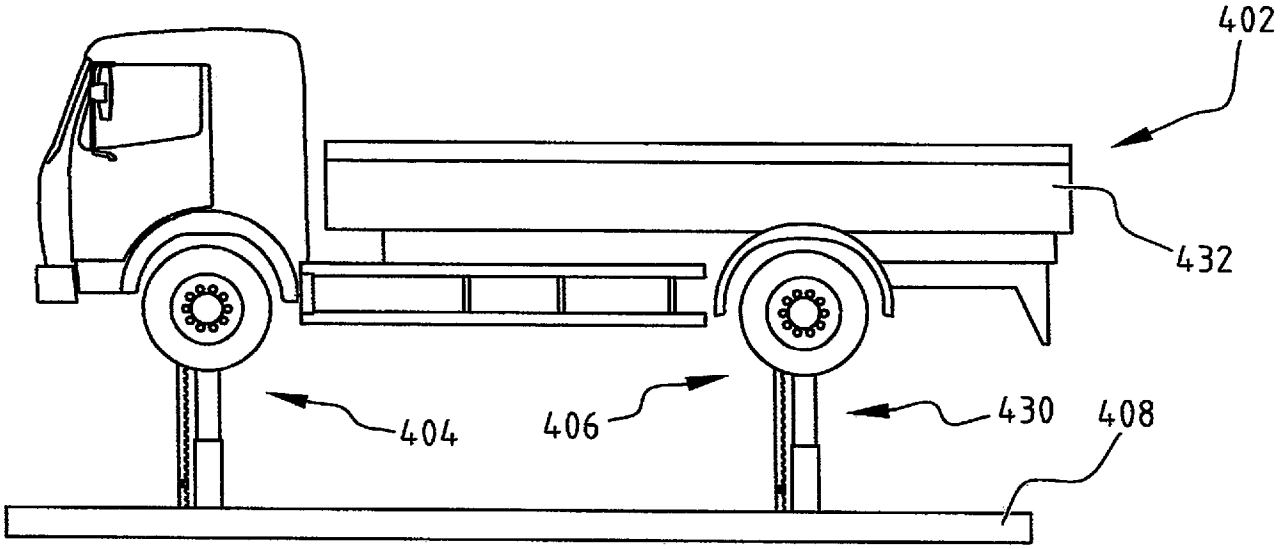

In a further alternative embodiment lifting system 402 (FIG. 8A-B) is of the in-ground lift type comprising stationary lifting column/device 404 and a moveable lifting column/device 406 that are located on or in floor 408. The front lifting column/device 404 is provided in cassette or box 410 with a telescopic lifting cylinder 412. On top of cylinder 412 there is provided carrier 414 with axle carriers 416. In the illustrated embodiment wheel edges or wheel recesses 418 are provided. Recesses 418 define the position of the front wheels of the vehicle. Furthermore, in the illustrated embodiment a hatch 420 is provided in front of the front lifting column/device 404 for maintenance, for example.

The moveable lifting column/device 406 moves in cassette or box 422 comprising a telescopic lifting cylinder 430. Box 422 provides a pit with a slot or recess 424 for guiding the moveable lifting column/device 406. Moveable lifting column/device 406 is provided with carrier 426 whereon axle carriers 428 are mounted. Depending on the type of vehicle 432 additional adapters can be provided that cooperate with carriers 414, 426 to enable engagement with different axle dimensions.

Figure 9:
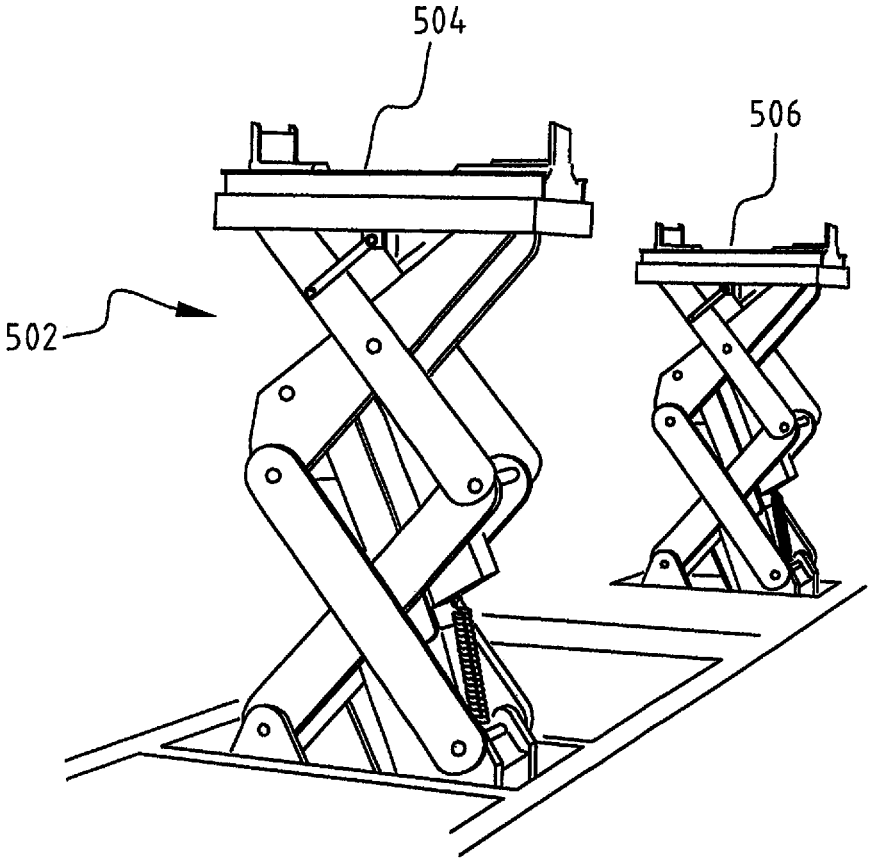

In an alternative lifting system 502 of the in-ground type (FIG. 9) the telescopic lifting cylinders 412, 430 of lifting system 402 are replaced by scissor type lifts 504, 506. It will be understood that operation of lifting systems 402, 502 of the in-ground type is similar.

It will be understood that the invention can be applied to a range of lifting systems such as described above, including but not limited to four-post and two-post lifting columns, such as the Stertil-Koni one post lifts ST1075, the Stertil-Koni two post lifts SK 2070, and the Stertil-Koni four post lifts ST 4120, skylift, mobile columns, and in-ground lifts, such as the Stertil in-ground Ecolift and the Stertil in-ground Diamond lift. Also, it will be understood that additional embodiments of the invention can be envisaged combining and/or switching features from the described and/or illustrated embodiments. For example, instead of light 110, 210, or in addition thereto, sound signals, indications on a control system etc. can be applied.

The present invention is by no means limited to the above described preferred embodiments. The rights sought are defined by the following claims within the scope of which many modifications can be envisaged. The present invention is described using a lifting device such as a lifting column and more specifically a mobile lifting column. The invention can also be applied to other type of lifting columns such as so-called boom-lifts, scissor-lifts and loading platforms. Such lifting equipment can be provided with the measures illustrated above according to the invention.

The invention claimed is:

1. A lifting device for lifting a vehicle, comprising:

a frame with a carrier configured for carrying the vehicle;

a drive which acts on the carrier, wherein the drive comprises an integrated hydraulic cylinder drive unit configured for raising the carrier, with the integrated hydraulic cylinder drive unit comprising:

a housing of a cylinder;

a piston rod vertically movable in the housing for raising or lowering of the carrier;

a height measuring system configured for measuring the displacement of the piston rod; and an integrated hydraulic fluid tank and motor unit that is configured for driving the piston rod with oil or hydraulic fluid under pressure, wherein the height measuring system comprises a locking system configured for locking the piston rod in response to an indication of the height measuring system that a desired position for the piston rod is reached, wherein the locking system comprises at least one rod clamp for horizontal inward movement of and direct contact by the at least one rod clamp against the piston rod to prevent displacement between the rod clamp and the piston rod and for horizontal outward movement of the at least one rod clamp to allow displacement between the rod clamp and the piston rod and wherein the locking system is configured to provide a continuously adjustable locking of the piston rod enabling locking of the piston rod at any position along a length of the piston rod, wherein the height measuring system activates the at least one rod clamp of the locking system for positive engagement of the at least one rod clamp against the piston rod and wherein the locking system rod clamp is positively engaged without being pressurized by the oil or hydraulic fluid under pressure, wherein the locking system further includes a clamp block and an inlet, wherein the inlet is provided with the oil or hydraulic fluid and the oil or hydraulic fluid acts directly against and forces the clamp block securing the rod clamp to release the rod clamp from the piston rod enabling displacement of the piston rod relative to the rod clamp, wherein the clamp block does not contact the piston rod but moves vertically to urge the horizontal inward movement of the at least one rod clamp, and wherein the locking system is utilized to both lock the piston rod at any position along the length of the piston rod with the height measuring system and also to lock and maintain in a safe position the piston rod when the oil or hydraulic fluid is accidentally removed from the system.

2. The lifting device according to claim 1, wherein the height measuring system comprises a sensor code provided on the piston rod, and a sensing element configured for reading the sensor code to determine the displacement of the piston rod.

3. The lifting device according to claim 2, wherein the sensor code is magnetic.

4. The lifting device according to claim 1, wherein the locking system comprises a plurality of rod clamps.

5. The lifting device according to claim 1, wherein the integrated hydraulic fluid tank and motor unit comprises a hydraulic fluid reservoir with a submerged pump.

6. The lifting device according to claim 5, wherein the reservoir comprises a direct valve connection between the reservoir and the housing.

7. The lifting device according to claim 1, wherein the height measurement system is configured to enable direct measurement of the displacement of the piston rod.

8. The lifting device according to claim 7, wherein the height measurement system is configured to enable direct and contactless measurement of the displacement of the piston rod.

9. The lifting device according to claim 8, wherein the height measuring system comprises a sensor code provided on the piston rod, and a sensing element configured for reading the sensor code to determine the displacement of the piston rod.

10. The lifting device according to claim 1, wherein the height measurement system comprises a level sensor configured to measure the level of hydraulic fluid in the reservoir.

11. The lifting device according to claim 1, wherein the locking system further includes a spring element to urge the at least one rod clamp against the piston rod.

12. The lifting device according to claim 1, wherein each rod clamp is a semi-circular body which increases the contact area between the rod clamp and the piston rod.

13. A lifting system comprising a plurality of lifting devices according to claim 1.

14. A method for lifting a vehicle using a lifting device, wherein the lifting device has:

a frame with a carrier configured for carrying the vehicle;

a drive which acts on the carrier, wherein the drive comprises an integrated hydraulic cylinder drive unit configured for raising the carrier, with the integrated hydraulic cylinder drive unit comprising:

a housing of a cylinder;

a piston rod vertically movable in the housing for raising or lowering of the carrier;

a height measuring system configured for measuring the displacement of the piston rod; and an integrated hydraulic fluid tank and motor unit that is configured for driving the piston rod with oil or hydraulic fluid under pressure, wherein the height measuring system comprises a locking system configured for locking the piston rod in response to an indication of the height measuring system that a desired position for the piston rod is reached, wherein the locking system comprises at least one rod clamp for horizontal inward movement of and direct contact by the at least one rod clamp against the piston rod to prevent displacement between the rod clamp and the piston rod and for horizontal outward movement of the at least one rod clamp to allow displacement between the rod clamp and the piston rod and wherein the locking system is configured to provide a continuously adjustable locking of the piston rod enabling locking of the piston rod at any position along a length of the piston rod, wherein the height measuring system activates the at least one rod clamp of the locking system for positive engagement of the at least one rod clamp against the piston rod and wherein the locking system rod clamp is positively engaged without being pressurized by the oil or hydraulic fluid under pressure, wherein the locking system further includes a clamp block and an inlet, wherein the inlet is provided with the oil or hydraulic fluid and the oil or hydraulic fluid acts directly against and forces the clamp block securing the rod clamp to release the rod clamp from the piston rod enabling displacement of the piston rod relative to the rod clamp, wherein the clamp block does not contact the piston rod but moves vertically to urge the horizontal inward movement of the at least one rod clamp, wherein the locking system is utilized to both lock the piston rod at any position along the length of the piston rod with the height measuring system and also to lock and maintain in a safe position the piston rod when hydraulic fluid is accidentally removed from the system, and wherein the method is comprised of the step of lifting the vehicle using the lifting device.

15. The lifting device according to claim 14, wherein each rod clamp is a semi-circular body which increases the contact area between the rod clamp and the piston rod.

16. A method for lifting a vehicle using a lifting system having a plurality of lifting devices, wherein each lifting device comprises:

a frame with a carrier configured for carrying the vehicle;

a drive which acts on the carrier, wherein the drive comprises an integrated hydraulic cylinder drive unit configured for raising the carrier, with the integrated hydraulic cylinder drive unit comprising:

a housing of a cylinder;

a piston rod vertically movable in the housing for raising and lowering of the carrier;

a height measuring system configured for measuring the displacement of the piston rod; and an integrated hydraulic fluid tank and motor unit that is configured for driving the piston rod with oil or hydraulic fluid under pressure, wherein the height measuring system comprises a locking system configured for locking the piston rod in response to an indication of the height measuring system that a desired position for the piston rod is reached, wherein the locking system comprises at least one rod clamp for horizontal inward movement of and direct contact by the at least one rod clamp against the piston rod to prevent displacement between the rod clamp and the piston rod and for horizontal outward movement of the at least one rod clamp to allow displacement between the rod clamp and the piston rod and wherein the locking system is configured to provide a continuously adjustable locking of the piston rod enabling locking of the piston rod at any position along a length of the piston rod, wherein the height measuring system activates the at least one rod clamp of the locking system for positive engagement of the at least one rod clamp against the piston rod and wherein the locking system rod clamp is positively engaged without being pressurized by the oil or hydraulic fluid under pressure, wherein the locking system further includes a clamp block and an inlet, wherein the inlet is provided with the oil or hydraulic fluid and the oil or hydraulic fluid acts directly against and forces the clamp block securing the rod clamp to release the rod clamp from the piston rod enabling displacement of the piston rod relative to the rod clamp, wherein the clamp block does not contact the piston rod but moves vertically to urge the horizontal inward movement of the at least one rod clamp, wherein the locking system is utilized to both lock the piston rod at any position along the length of the piston rod with the height measuring system and also to lock and maintain in a safe position the piston rod when hydraulic fluid is accidentally removed from the system, and wherein the method is comprised of the step of lifting the vehicle using the lifting system.

17. The lifting device according to claim 16, wherein each rod clamp is a semi-circular body which increases the contact area between the rod clamp and the piston rod.

* * * * *